United States Patent [19]

Tamura

[11] Patent Number: 4,954,077

[45] Date of Patent: Sep. 4, 1990

[54] GAS LIGHTER

[76] Inventor: Takemi Tamura, 3-12-1 Bubaicho, Fuchushi, Tokyo 183, Japan

[21] Appl. No.: 250,832

[22] Filed: Sep. 28, 1988

[51] Int. Cl.[5] ..... F23Q 2/00

[52] U.S. Cl. ..... 431/145; 431/320; 44/52

[58] Field of Search ..... 44/52, 59; 431/145, 431/126, 278, 320, 325

[56] References Cited

U.S. PATENT DOCUMENTS

| | | | |
|---|---|---|---|
| 1,944,175 | 1/1934 | Frey | 44/52 |
| 2,322,617 | 6/1943 | Dayhuff | 44/52 |
| 3,468,615 | 9/1969 | Carey | 431/126 |
| 3,790,332 | 2/1974 | Woollard | 431/126 |
| 4,472,135 | 9/1984 | Parker et al. | 431/126 |
| 4,614,625 | 9/1986 | Wilson | 431/126 |

FOREIGN PATENT DOCUMENTS

| | | | |
|---|---|---|---|
| 0003904 | 1/1974 | Japan | 44/52 |
| 1385199 | 2/1975 | United Kingdom | 44/52 |

*Primary Examiner*—Carl F. Dees

*Attorney, Agent, or Firm*—Breneman & Georges

[57] ABSTRACT

A gas lighter adapted for sending forth a desired fragrance whenever a liquefied gas is issued from an injection nozzle, comprises a gas container which contains a liquefied gas composed of a liquefied butane gas and a small amount of a perfume.

10 Claims, 1 Drawing Sheet

GAS LIGHTER

BACKGROUND OF THE INVENTION

1. Field of the Invention

This invention relates to gas lighters and, more particularly, to gas lighters which are able to send forth various agreeable fragrances when lit.

2. Description of the Prior Art

In recent years, there have been proposed fragrance-shedding lighters. For instance, Japanese Laid-open Utility Model No. 60-176350 describes a lighter having a non-combustible solid aromatic disposed around a lighting nozzle of the like to send forth the fragrance.

This fragrance-shedding lighter is so arranged that the non-combustible solid aromatic disposed around the ignition nozzle gives out an agreeable fragrance which one can enjoy.

However, since the aromatic of the lighter is disposed around the nozzle as exposed, the fragrance is invariably sent forth and thus disappears only within several days with an attendant problem that the fragrance deposits on clothes, tobaccos and the like.

SUMMARY OF THE INVENTION

An object of the present invention is to provide a gas lighter in which a fragrance is sent forth only when an injection nozzle for a gas is opened for lighting the lighter, without invariable emanation of the fragrance, so that a perfume is consumed only in very small amounts and is kept long.

Another object of the present invention is to provide a gas lighter which is so arranged that the fragrance of a perfume does not deposit on clothes, tobaccos and the like.

According to the present invention, there is provided a gas lighter adapted for sending forth a desired fragrance whenever a liquefied gas is issued from an injection nozzle, the gas lighter having a gas container which is filled with a liquefied gas comprised of a liquefied butane gas and a small amount of a perfume.

The manner of lighting or ignition of the gas lighter according to the present invention may be of a type in which a rotary file and a lighter flint are frictionally contacted, or of an electric sparking type.

The gas lighter may be of a disposable type in which when the liquefied gas filled in the gas container is used up, re-charge of the gas is not possible, or of a re-chargeable type in which the gas is re-chargeable.

The liquefied gas to be mixed with perfumes is preferably a butane gas. In order to cause a mixed perfume to give out the fragrance inherent to the perfume or to prevent a firing failure of the injection nozzle as would occur by mixing with the perfume, it is more preferable to use an isobutane gas which has been deodorized and purified with a high purity. In general, the deodorized and purified isobutane gas has a purity of not less than 98 wt %.

The perfume to be mixed may be in the form of a solid (granules or powder) or a liquid or may be natural or synthetic provided that it is miscible with a liquefied gas. Preferably, at least one perfume ingredient selected from the following group is mixed with the liquefied gas.

The group includes synthetic or natural essential oils such as limonene, and lemon oil, orange oil, grape fruit oil, lime oil and bergamot oil comprised chiefly of limonene, methyl isobutyrate, ethyl n-butyrate, ethyl caprylate, ethyl propionate, ethyl isovalerate, ethyl-2-methyl butyrate, isoamyl acetate, isoamyl isovalerate, isoamyl n-butyrate, n-butyl isovalerate, ethyl acetoacetate, cis-3-hexenyl isovalerate, linalyl acetate, citronellyl acetate, geranyl acetate, cinnamyl acetate, benzyl acetate, citral, carvone and mixtures thereof.

These perfume ingredients need not be purified when mixed with the liquefied gas and can be used as commercially sold.

The perfume ingredients have miscibility with liquefied gases and particularly a liquefied butane gas under ordinary conditions. In this connection, however, when the perfume ingredient to be mixed with the liquefied gas is in the form of a powder or granules or exhibits poor miscibility with the liquefied gas by further addition of perfumes other than those used as the essential ingredients, a suitable solvent, such as an isoparaffinic hydrocarbon oil or diethyl phthalate, is added along with the perfumes.

Where synthetic or natural perfume ingredients other than those indicated above are added, the defined perfume ingredients and/or their mixture with the defined solvent should preferably be contained in an amount of not less than 60 wt % of the total amount of all the perfume ingredients including synthetic or natural perfumes other than those defined above.

In this manner, strawberry, green apple, lemon, jasmine and other perfumes with ordinarily favored various fragrances, which have good miscibility with liquefied gases such as a liquefied butane gas, can be prepared.

The amount of the perfumes to be mixed with the liquefied gas is only small and is preferably in the range of from 0.1 to 10 wt % of the liquefied gas.

In ordinary gas lighters, a gas is injected from a nozzle instantaneously just before lighting or ignition. When a liquefied gas with which a small amount of perfumes is mixed is filled in a gas container as in the gas lighter of the present invention, the perfumes are injected in the air along with the gas at the time of lighting, permitting the fragrance to be sent forth transiently. However, during combustion of the gas, no fragrance is given out.

The gas lighter of the present invention can send forth the fragrance of perfumes by injection of the liquefied gas and perfumes when the nozzle is merely opened without lighting.

Since any fragrance is not given out unless the gas lighter is lit or the nozzle is opened, the fragrance does not deposit on the clothes or other articles when the gas lighter is carried in a pocket. So far as the liquefied gas is left in the gas container, the fragrance can invariably be sent forth.

BRIEF DESCRIPTION OF THE DRAWING

The sole figure is a schematic sectional view of part of a gas lighter according to the present invention.

DESCRIPTION OF THE PREFERRED EMBODIMENT

Figure 1:
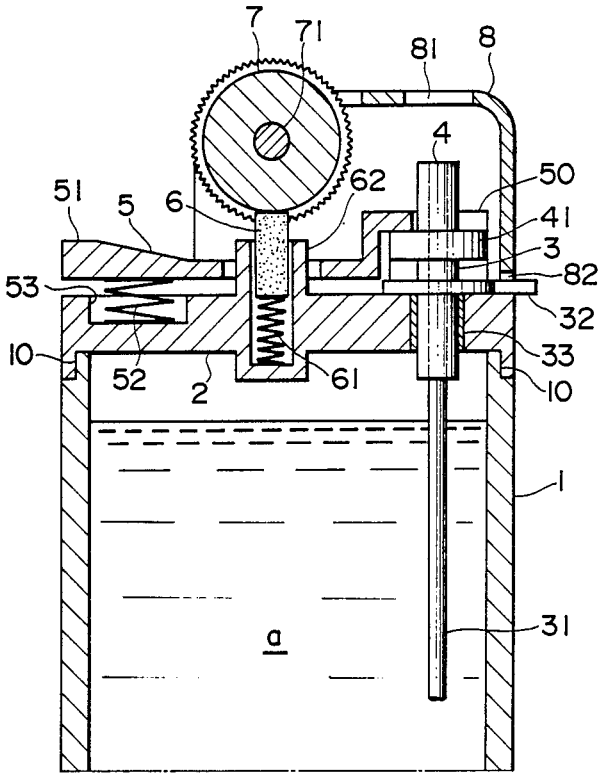

The sole figure illustrates a gas lighter according to an embodiment of the present invention.

The gas lighter includes a metallic gas container 1 having a mounting base 2, serving also as a cover, fixed at an upper open margin 10, thereby hermetically sealing the container 1. The container 1 is filled with a liquefied gas (a) consisting of a butane gas mixed with a small amount of a perfume.

At one end of the mounting base 2, a valve 3 is hermetically passed through a seal ring 33 and has an injection nozzle 4 at an upper end and a tube 31 at a lower end thereof. The tube 31 extends at the lower end thereof to an inner bottom the gas container 1.

The injection nozzle 4 has a flange 41 at the lower end, with which a base end 51 of an operation lever 5 is connected for lighting operations. The operation lever 5 has a base end 51 extending to the other end of the mounting base 2. The end 51 is urged upwardly by means of a controlling spring 52 provided within a spring accommodating portion 53 formed in the mounting base 2 so that the operation lever 5 is invariably held in a posture as shown in the figure.

At part of an upper portion of the mounting base 2 is fixed a metal cover 8 in such a way that the base end 51 of the operation lever is exposed as projected. The cover 8 has an opening 81 so the flame from the injection nozzle 4 is not intercepted. Moreover, a rotary file 7 of a disk form is mounted on a shaft 71, part of which is arranged to project from the cover 8.

The mounting base 2 has a cylinder 62 projecting substantially from an upper central portion, into which a lighter flint 6 is inserted. The cylinder 62 has a spring 61 on an inner bottom thereof, by which the lighter flint 6 is urged upwardly to force it into contact with the rotary file 7.

Reference numeral 32 denotes an adjusting lever for an amount of an injection gas and laterally extending from a hole 82 bored in a lower end of the cover 8. The lever 32 is in association with the valve 3. When the lever 32 is laterally swung, the valve 3 is rotated to control the amount of the gas injected from the nozzle 4.

In operation, when the rotary file 7 is rotated with a finger in a counterclockwise direction as viewed in the figure and the base end 51 of the operation lever is pushed downward, sparklets are emitted by frictional contact between the rotary file 7 and the flint 6 toward the nozzle 4. At this time, the injection nozzle 4 rises slightly upwardly to open the valve 3 whereupon the gas injected from the nozzle 4 is lit. Spontaneously before the lighting, the perfume in the liquefied gas (a) is issued with the gas from the injection nozzle 4 and scattered in the air, permitting the fragrance to float thereabout. Thus, one can enjoy the fragrance.

To further enjoy the fragrance, the operation lever 5 alone is pushed without contact of the rotary file 7. During the course of pushing the operation lever 5, the fragrance is invariably given out along with the gas from the nozzle.

The perfume to be mixed with the liquefied gas (a) may be arbitrarily selected from various perfumes giving out ordinarily favored fragrances. For instance, a lemon perfume may be prepared by mixing 100 parts by weight of citral, 10 parts by weight of citronelyl acetate, 450 parts by weight of limonene, 50 parts by weight of linalyl acetate, 5 parts by weight of geranyl acetate and 385 parts by weight of orange oil. This perfume is mixed with a deodorized and purified isobutane gas in an amount of 5 wt % to obtain a liquefied gas (a) giving out the fragrance of lemon.

What is claimed is:

1. A fragrance emitting gas lighter comprising:

(a) a hermetically sealed gas container containing a liquefied, deodorized and purified butane gas and about 0.1 to 10% by weight perfume to said liquefied, deodorized and purified butane gas and wherein said perfume is selected from the group consisting of limonene, lemon oil, orange oil, grapefruit oil, lime oil, bergamot oil, methyl isobutyrate, ethyl n-butyrate, ethyl caprylate, ethyl propionate, ethyl isovalerate, ethyl-2-methyl butyrate, isoamyl acetate, isoamyl isovalerate, isoamyl n-butyrate, n-butyl isovalerate, ethyl acetoacetate, cis-3-hexenyl isovalerate, linalyl acetate, citronellyl acetate, geranyl acetate, cinnamyl acetate, benzyl acetate, citral, carvone and solid fragrances of strawberry, green apple, lemon and jasmine;

(b) a perfume solvent contained in said container;

(c) an injection nozzle connected through a hermetically sealed passage to said gas container;

(d) a valve connected between said injection nozzle and said hermetically sealed passage;

(e) a spark ignition means disposed adjacent to said injection nozzle;

(f) means for opening and closing said valve to release said liquefied, deodorized and purified butane gas and said perfume combination to provide the release of fragrance from said gas container; and (g) means for activating said spark ignition means to ignite and burn said liquefied, deodorized and purified butane gas and said fragrance.

2. The fragrance emitting gas lighter of claim 1 wherein said liquefied, deodorized and purified butane gas is a deodorized and purified isobutane gas having a purity of about 98% by weight.

3. The fragrance emitting gas lighter of claim 1 wherein said perfume is in a solid form in said liquefied, deodorized and purified butane gas.

4. The fragrance emitting gas lighter of claim 1 wherein said perfume solvent is isoparaffinic hydrocarbon oil or diethyl phthalate.

5. The fragrance emitting gas lighter of claim 4 wherein said solid perfume is selected from a group of solid fragrances consisting of strawberry, green apple, lemon, jasmine or a combination thereof.

6. The fragrance emitting gas lighter of claim 1 further comprising means for varying the size of the opening of said injection nozzle.

7. The fragrance emitting gas lighter of claim 1 further comprising a cover disposed above said injection nozzle having an opening for the flame.

8. A perfume emitting cigarette lighter comprising:

(a) a hermetically sealed gas container containing a liquefied, deodorized and purified butane gas and a miscible perfume in a solid or liquid form selected from the group consisting of strawberry, green apple, lemon, jasmine, orange, grapefruit, lime, limonene, bergamot oil, methyl isobutyrate, ethyl n-butyrate, ethyl caprylate, ethyl propionate, ethyl isovalerate, ethyl-2-methyl butyrate, isoamyl acetate, isoamyl isovalerate, isoamyl n-butyrate, n-butyl isovalerate, ethyl acetoacetate, cis-3-hexenyl isovalerate, linalyl acetate, citronellyl acetate, geranyl acetate, cinnamyl acetate, benzyl acetate, citral, carvone and combinations thereof:

(b) an injection nozzle and valve combination connected to said hermetically sealed gas container;

(c) a spark ignition source disposed adjacent to said injection nozzle and valve combination;

(d) means for opening and closing said valve means for releasing said liquefied, deodorized and purified butane gas and said perfume; and (e) means for activating said spark ignition source to burn said liquefied, deodorized and purified butane gas and said perfume.

9. The perfume emitting cigarette lighter of claim 8 wherein said liquefied, deodorized and purified butane gas is a deodorized and purified isobutane gas.

10. The perfume emitting cigarette lighter of claim 9 further comprising a perfume solvent selected from the group consisting of isoparaffinic hydrocarbon oil or diethyl phthalate.

* * * * *